United States Patent [19]

Diekmann et al.

[11] Patent Number: 4,951,646

[45] Date of Patent: Aug. 28, 1990

[54] VENTILATED GLASS-TOP COOKING UNIT

[75] Inventors: Helmut Diekmann, Menden; Gunter Krohn, Hemer; Wilhelm Cramer, Sundern, all of Fed. Rep. of Germany

[73] Assignee: Cramer GmbH & Co. Kommanditgesellschaft, Menden, Fed. Rep. of Germany

[21] Appl. No.: 441,902

[22] Filed: Nov. 28, 1989

[30] Foreign Application Priority Data

Dec. 28, 1988 [DE] Fed. Rep. of Germany ..... 3844081

[51] Int. Cl.[5] ..... F24C 3/00

[52] U.S. Cl. ..... 126/39 J; 126/39 D; 126/39 G

[58] Field of Search ..... 126/39 D, 39 K, 39 F, 126/39 R, 39 J, 39 G

[56] References Cited

U.S. PATENT DOCUMENTS

| | | | |
|---|---|---|---|
| 3,663,798 | 5/1972 | Speidel et al. | 126/39 J |
| 3,698,378 | 10/1972 | Rosenberg et al. | 126/39 J |
| 3,785,364 | 1/1974 | Reid et al. | 126/39 J |

*Primary Examiner*—Carroll B. Dority

*Attorney, Agent, or Firm*—Herbert Dubno

[57] ABSTRACT

A cooking unit has a housing having a front and a rear and formed at the rear with an upwardly open upright vent passage, a ceramic panel on the housing defining a plurality of cooking spots, a burner plate in the housing spaced underneath the panel and defining therewith an upper compartment opening upward into the passage, and respective gas burners supported on the plate underneath the spots. Thus the burners can heat the respective spots of the panel. An equipment plate in the housing spaced underneath the burner plate defines therewith an intermediate compartment also opening upward into the passage and defines beneath itself in the housing a lower compartment that is open to the outside at the front of the housing. Control equipment is mounted in the lower compartment of the housing along with a blower having an intake in this lower compartment and an outlet in the vent passage. This blower is powered, normally electrically, so as to draw a primary stream of air in from the front of the housing and through the lower compartment and to expel it upward into the passage. This primary current aspirates secondary streams of air from the upper and intermediate compartments by venturi action.

10 Claims, 1 Drawing Sheet

VENTILATED GLASS-TOP COOKING UNIT

FIELD OF THE INVENTION

The present invention relates to a glass-topped cooking unit. More particularly this invention concerns a gas fired glass cooktop.

BACKGROUND OF THE INVENTION

A stove or cooktop is known having an upper surface formed by a heat-resistant glass panel. A burner plate spaced underneath this panel is provided with a plurality of gas burners each positioned under a specific separately marked location of the overlying ceramic panel. Gas issuing from these burners is ignited to heat the respective locations on the panel. Normally a vent passage is formed that opens into the upper compartment formed between the burner plate and the glass panel to allow gases to be vented.

As a rule the burner plate is insulated heavily around the burners to protect underlying components of the cooker. Gases are vented from the stove wholly by convective action. As a rule relatively delicate components are housed in the stove underneath the burner plate and these components must be protected from the heat of the burners. Even with substantial insulation of the burner plate, these components are often subjected to substantial heat stress.

OBJECTS OF THE INVENTION

It is therefore an object of the present invention to provide an improved glass-topped cooking unit.

Another object is the provision of such an improved glass-topped cooking unit which overcomes the above-given disadvantages, that is which protects the fragile electronic components from heat.

SUMMARY OF THE INVENTION

A cooking unit according to this invention has a housing having a front and a rear and formed at the rear with an upwardly open upright vent passage, a ceramic panel on the housing defining a plurality of cooking spots, a burner plate in the housing spaced underneath the panel and defining therewith an upper compartment opening upward into the passage, and respective gas burners supported on the plate underneath the spots. Thus the burners can heat the respective spots of the panel. An equipment plate in the housing spaced underneath the burner plate defines therewith an intermediate compartment also opening upward into the passage and defines beneath itself in the housing a lower compartment that is open to the outside at the front of the housing. Control equipment is mounted in the lower compartment of the housing along with a blower having an intake in this lower compartment and an outlet in the vent passage. This blower is powered, normally electrically, so as to draw a primary stream of air in from the front of the housing and through the lower compartment and to expel it upward into the passage. This primary current aspirates secondary streams of air from the upper and intermediate compartments by venturi action.

Thus with the system of this invention the electronic components in the lower compartment are actively cooled by incoming outside air. In addition the combustion gases from the upper compartment are mixed with the primary ambient-air stream so that the overall temperature of the exiting gases is substantially reduced.

According to this invention the equipment plate is at least partially insulated. It does not need substantial insulation and the burner plate can be wholly uninsulated sheet metal.

For best cooling effect the blower is has a drum extending generally the full width of the cooking unit inside the lower passage. In addition the rear vent passage extends the full width of the cooker, and the outlets of the upper and intermediate compartments into the passage are also full-width. The primary stream passes through the blower and is full-width where it enters the passage.

To further increase the entrainment of the secondary streams by the primary stream the intermediate compartment is provided with an outlet opening into the passage and formed with upwardly directed venturi vanes. Similarly the upper compartment is provided with an outlet opening into the passage and formed with upwardly directed venturi vanes and is provided forward of the respective outlet with flow-interrupting baffles of an insulating material.

To control the blower the cooking unit is provided with a main on/off switch and the blower is connected to the switch such that it is powered whenever the switch is on. In addition a temperature-sensitive device in the lower compartment powers the blower whenever the temperature in the lower compartment exceeds a predetermined upper limit. This temperature-responsive switching can be in addition to the regular switching as the stove is turned on and off to keep the blower running after the stove is shut off until it has cooled down.

DESCRIPTION OF THE DRAWINGS

The above and other objects, features, and advantages will become more readily apparent from the following, reference being made to the accompanying drawing in which.

SPECIFIC DESCRIPTION

Figure 1:
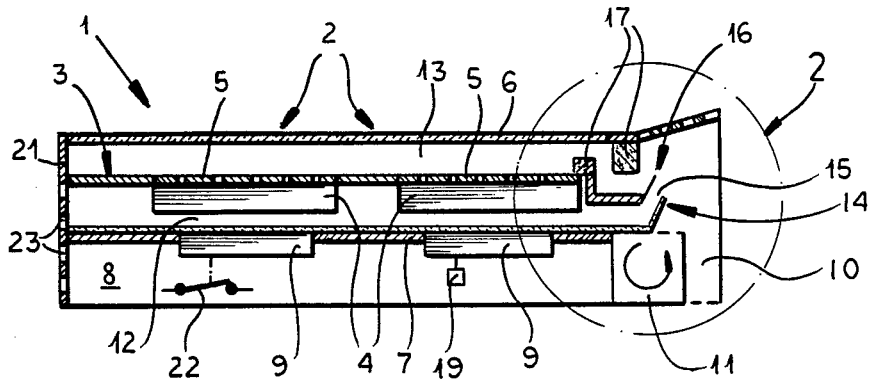
FIG. 1 is a partly diagrammatic vertical section through the stove according to this invention.

As seen in FIG. 1 a stove 1 has a housing 21 with an upper surface formed by a glass panel 2 underneath which is provided a burner plate 3. Individual burners 4 are set with respective nozzle plates 5 into the burner plate 3 which itself forms an upper compartment 13 with the lower surface of the ceramic panel 2. The upper surface of this panel 2 is marked above each of the burners 4 with a ring to indicate the respective cooking location.

Spaced underneath the burner plate 3 is an insulated horizontal equipment plate 7 defining with the burner plate 3 an intermediate compartment 12 and defining underneath itself a lower compartment 8. The housing 21 of the stove is formed at its front side (to the left in the drawing) with vent openings 23 at the compartments 8 and 12. Electronic control equipment 9 is mounted in the compartment 8 to the underside of the plate 7.

Figure 2:
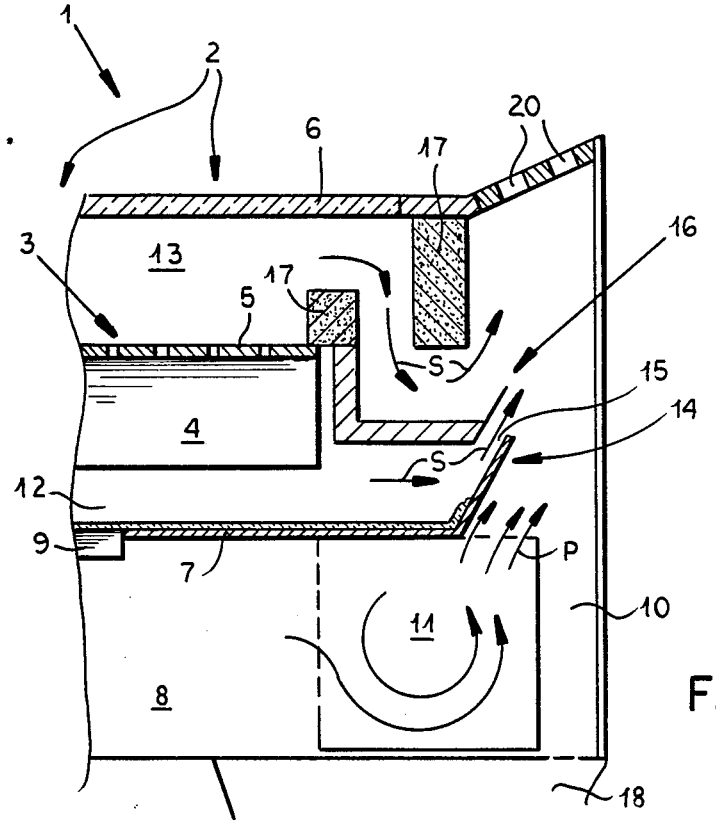
FIG. 2 is a large-scale and partly diagrammatic view of the detail indicated at 2 in FIG. 1.

In addition the housing 21 forms at the extreme rear of the stove 1 a vertically extending vent passage 10 opening downward to the outside at 18 (FIG. 2) and opening at its upper end at holes 20 which may be connected to an exhaust duct. This passage 10 extends the full width of the stove, that is perpendicular to the planes of the views of FIGS. 1 and 2.

According to this invention the lower compartment 8 is provided at its rear side with a drum-type blower 11 whose intake draws a primary stream of air into the compartment 8 via the vent holes 23 and whose output directs this primary stream upward in the passage 10. The intermediate compartment 12 is provided with full width of its rear end with an upwardly directed vane 14 defining an outlet 15 opening upward into the passage 10. The upper compartment 13 similarly has a vane 16 and opens upward into the passage 10 above the outlet 15. Thus the primary current of air rising is indicated by arrows P in FIG. 2 in the passage 10 will entrain secondary currents of air indicated by arrows S from the compartments 12 and 13. The gases issuing from the upper compartment 13 include spent combustion gases and are deflected over baffles 17 formed of insulating material.

The blower 11 is normally controlled by the main on-off switch 22 of the stove 1. The control equipment 9 is also provided in the compartment 8 with a temperature sensor 19 that turns the blower 11 on whenever the temperature in the compartment 8 exceeds a predetermined threshold, normally about 40° C. This temperature control is independent of control via the switch 22 so that the blower 11 will continue to operate even after the stove 1 is shut-off, until it has cooled down. Thus with the system of this invention the compartments 8 and 12 are actively cooled and ventilated. Excessive heat build up and damage to potentially fragile electric components of the equipment 9 are avoided.

We claim:

1. A cooking unit comprising:

a housing having a front and a rear and formed at the rear with an upwardly open upright vent passage;

a ceramic panel on the housing defining a plurality of cooking spots;

a burner plate in the housing spaced underneath the panel and defining therewith an upper compartment opening upward into the passage;

respective gas burners supported on the plate underneath the spots, whereby the burners can heat the respective spots of the panel;

an equipment plate in the housing spaced underneath the burner plate and defining therewith an intermediate compartment also opening upward into the passage, the equipment plate defining beneath itself in the housing a lower compartment that is open to the outside at the front of the housing;

control equipment in the lower compartment of the housing;

a blower in the lower compartment having an intake therein and an outlet in the vent passage; and means for powering the blower and thereby drawing a primary stream of air in from the front of the housing and through the lower compartment and expelling it upward into the passage and for aspirating secondary streams of air from the upper and intermediate compartments by venturi action of the primary stream in the passage.

2. The cooking unit defined in claim 1 wherein the equipment plate is at least partially insulated.

3. The cooking unit defined in claim 1 wherein the blower is has a drum extending generally the full width of the cooking unit inside the lower passage.

4. The cooking unit defined in claim 3 wherein the primary stream passes through the blower.

5. The cooking unit defined in claim 1 wherein the intermediate compartment is provided with an outlet opening into the passage and formed with upwardly directed venturi vanes.

6. The cooking unit defined in claim 1 wherein the upper compartment is provided with an outlet opening into the passage and including an upwardly directed venturi vane and flow-interrupting baffles of an insulating material.

7. The cooking unit defined in claim 1 wherein the cooking unit is provided with a main on/off switch, the blower being connected to the switch such that it is powered whenever the switch is on.

8. The cooking unit defined in claim 1 wherein the means for powering the blower includes a temperature-sensitive device in the lower compartment and control means for powering the blower whenever the temperature in the lower compartment exceeds a predetermined upper limit.

9. The cooking unit defined in claim 1 wherein the burner plate includes respective nozzle plates at the respective burners.

10. The cooking unit defined in claim 1 wherein the housing is formed on its front in at least the intermediate and lower compartments with vent holes.

* * * * *